United States Patent [19]

Stevens et al.

[11] 4,232,066

[45] Nov. 4, 1980

[54] METHOD AND APPARATUS FOR DIPPING METAL FENCE POSTS

[75] Inventors: Joel B. Stevens, McMinnville; Mark C. Wirfs, Beaverton, both of Oreg.

[73] Assignee: Cascade Steel Rolling Mills, Inc., McMinnville, Oreg.

[21] Appl. No.: 938,704

[22] Filed: Aug. 31, 1978

[51] Int. Cl.[3] ..... B05C 13/00

[52] U.S. Cl. ..... 427/430.1; 118/421; 118/425

[58] Field of Search ..... 118/421, 425, 423, DIG. 12, 118/426; 427/430 R, 435; 198/342; 414/225, 745, 737, 751, 738

[56] References Cited

U.S. PATENT DOCUMENTS

| | | | |
|---|---|---|---|
| 2,857,878 | 10/1958 | Matson et al. | 118/421 |
| 3,497,084 | 2/1970 | Murrah | 414/745 X |
| 3,643,626 | 2/1972 | Mckay et al. | 118/426 |
| 3,901,180 | 8/1975 | Allen et al. | 414/225 X |
| 3,968,020 | 7/1976 | Nagano et al. | 118/DIG. 12 |
| 3,986,518 | 10/1976 | Sato | 118/425 |

*Primary Examiner*—Shrive P. Beck

*Attorney, Agent, or Firm*—Klarquist, Sparkman, Campbell, Leigh, Hall & Whinston

[57] ABSTRACT

A white cap dipper apparatus for metal fence posts and a method of dipping such posts, wherein the apparatus includes a shuttle car having a tilt frame for removing posts in successive groups from horizontal flow path cables, successively elevating such posts and dipping the same, and then returning the posts to the cables in horizontal position. The car reciprocates back and forth in the dipping zone in such timed relation to the flow path and with such speed that while it creates a gap in the flow path, it does not interrupt the continuity of the flow.

11 Claims, 7 Drawing Figures

FIG. 3
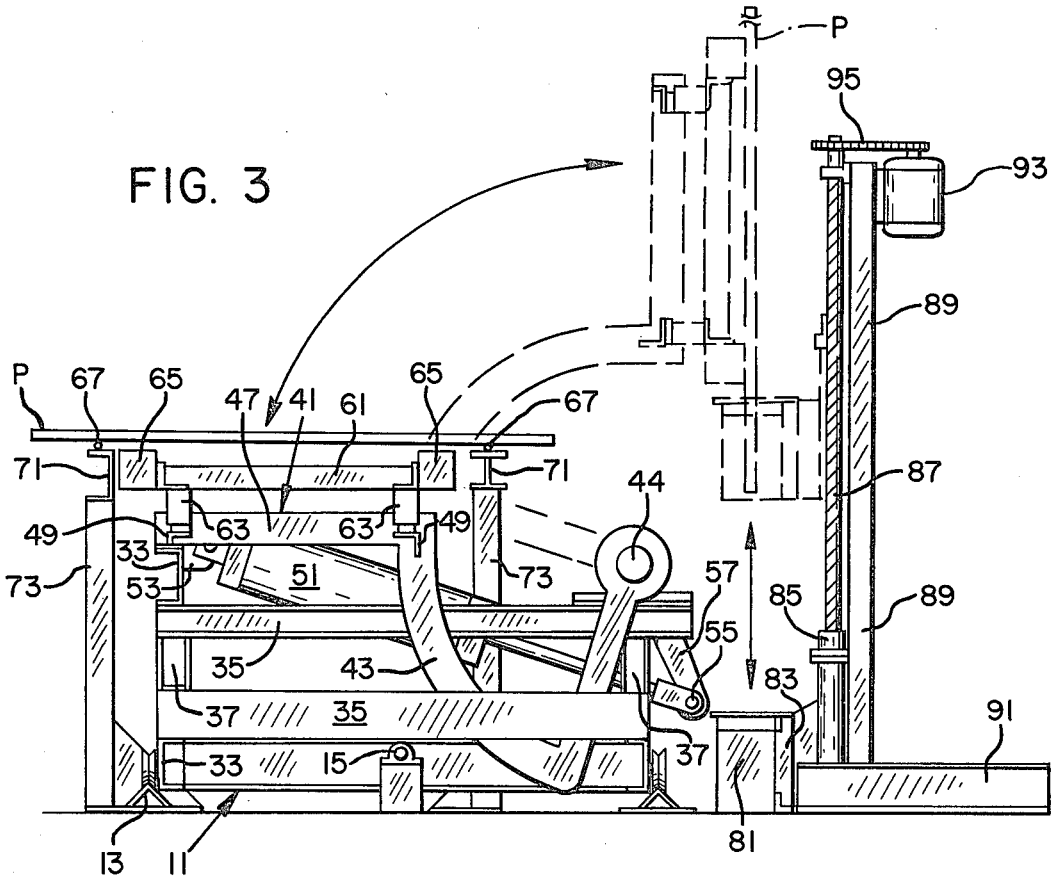
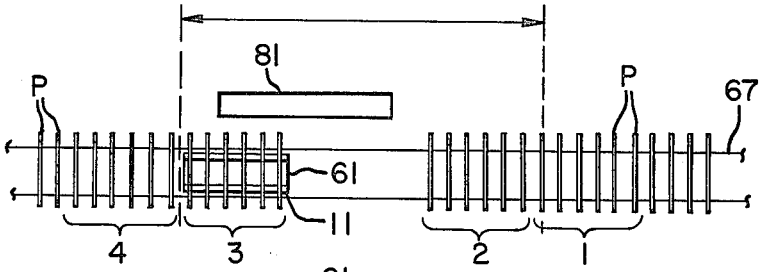
FIG. 4
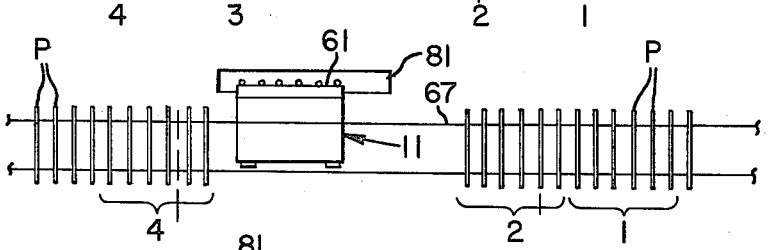
FIG. 5
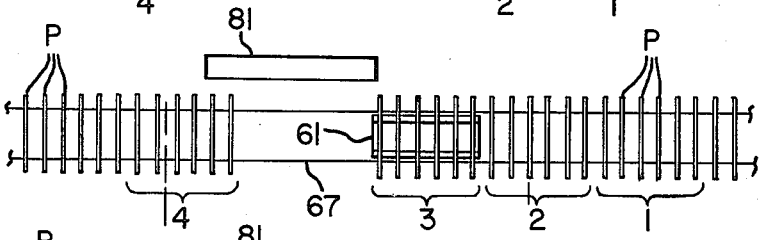
FIG. 6
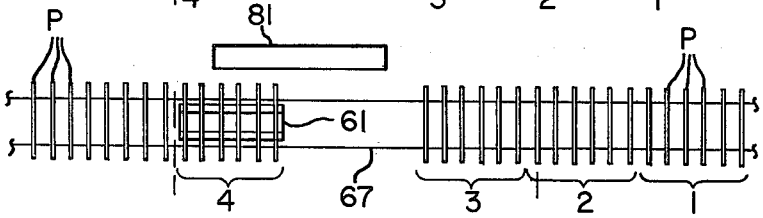
FIG. 7

METHOD AND APPARATUS FOR DIPPING METAL FENCE POSTS

FIELD OF THE INVENTION

This invention relates to metal fence post dipping apparatus for while capping metal fence posts.

BACKGROUND OF THE INVENTION

In the manufacture of metal fence posts, it is common practice to perform a number of operations on posts or post stock with them in horizontal positions, including the operation of applying an overall paint job to the posts. However, the trade demands that the posts be white capped. To our knowledge this has been done by terminating the horizontal flow in advance of the white capping operation, then taking the posts, hanging them vertically, and passing them through a white dip bath. This is time-consuming and thus an expensive operation, and it does not lend itself to being integrated into horizontal flow path of the preceding operations.

SUMMARY OF THE INVENTION

The present invention overcomes the above problems by providing an apparatus which can be integrated into the flow of horizontal posts. Our apparatus is interposed in the flow and without interrupting the same, removes posts in successive groups or batches from the flow, dips the same, drips the same and returns them horizontally into the flow path in step with previously dipped posts.

It is a main object of the present invention to provide a dipper for performing the above operations and to provide a method of dipping, including steps for effecting the above results.

BRIEF DESCRIPTION OF THE DRAWINGS

FIG. 3 is an elevational end view of the dipper; and

FIGS. 4–7 are schematic views showing the steps the dipper takes in performing the dipping operation.

DESCRIPTION OF THE PREFERRED EMBODIMENT

Figure 1:
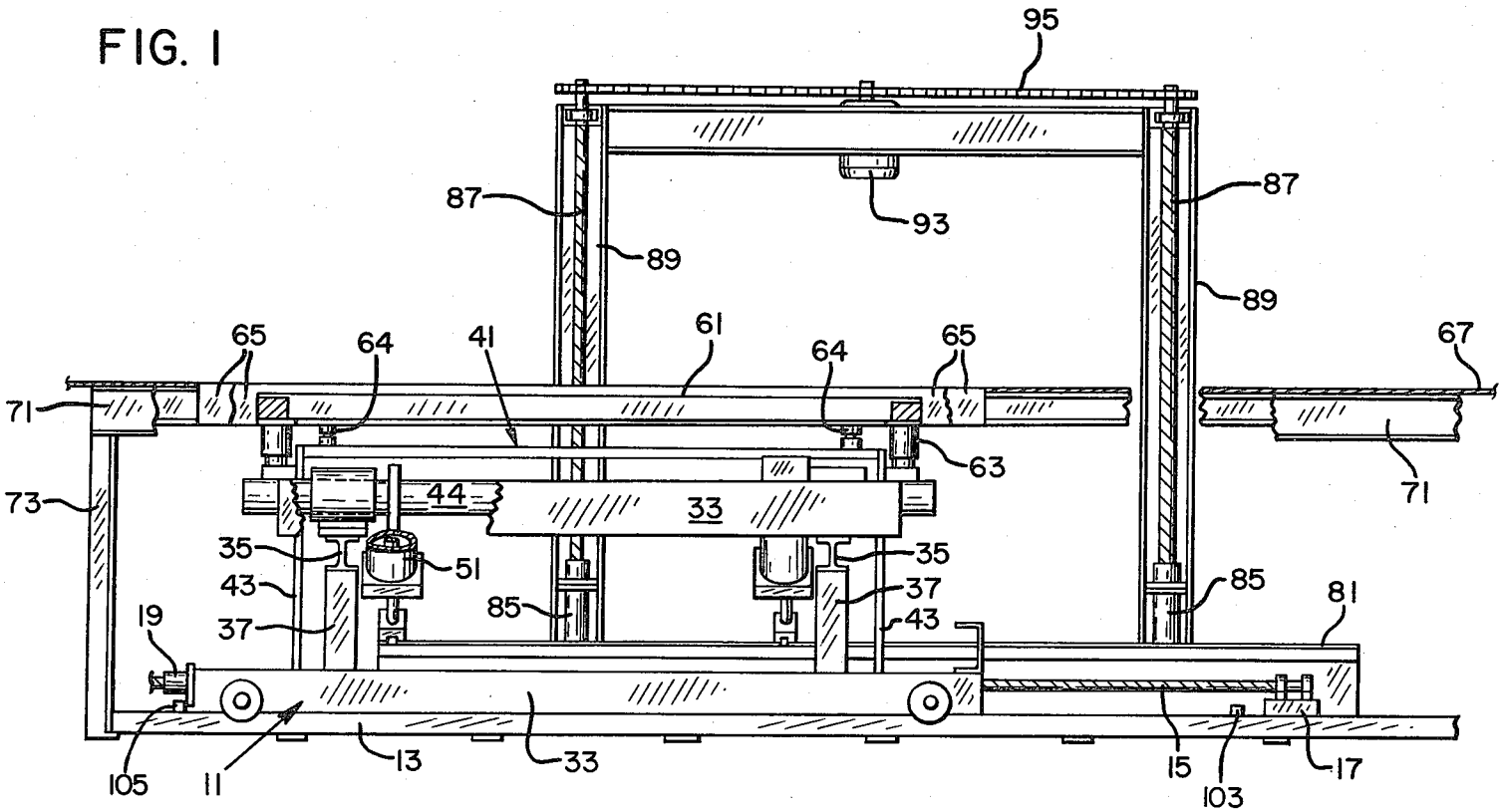
FIG. 1 is an elevational view of a dipper incorporating the concepts of the present invention.

The dipper includes a wheeled shuttle car II (FIG.1) riding on rails or tracks 13 which are secured to a floor (such as provided by a concrete slab). The shuttle car is driven back and forth by a ball screw 15 which is journaled at one end in a bearing block 17 (FIG. 2), and threads through a ball nut 19 (FIGS. 1 and 2) on the car. The screw has an extension in the form of a shaft to be driven alternately by a motor 21 or a motor 23 (FIG. 2) mounted on a base B. The motors drive sheaves 25 and 27, respectively, which are carried by clutches 29 and 31, respectively, mounted on the shaft portion of the ball screw 15. There is also an electrical brake 32 connected to the extension of the ball screw.

The car is shown as comprising an open box-like framework including upper and lower longitudinal members 33 (FIGS. 1 and 2), upper and lower cross members 35, and uprights 37.

A tilt carrier 41 (FIGS. 2 and 3) for the posts is supported on the car by a pair of generally bell-crank shaped arms 43 (FIG. 3) which are secured at one set of ends to a heavy shaft 44. The shaft is journaled by bearings 45 (FIG. 2) on pads 46 secured to upper cross members 35 near the right side of the machine as the parts are depicted in FIG. 3. The opposite ends of the arms 43 support the tilt carrier 41. In the particular embodiment of the invention shown, the carrier is, in fact, in part formed by extensions 47 on the arms (FIG. 3). The extensions are connected by a pair of longitudinal connecting pieces 49.

The arms are actuated by a pair of double-acting air cylinders 51 (FIG. 3) anchored at the cylinder ends at 53 to the uppermost longitudinal member 33 and are pivotally connected at their piston rod ends at 55 to levers 57. The levers are secured at their upper ends to shaft 44. When the piston and cylinder units are contracted, the carrier 41 is elevated to the broken line position in FIG. 3, whereas when the piston and cylinder units are extended, the carrier is lowered to the solid line position shown in FIG. 3, resting on the uppermost longitudinal member 33.

Figure 2:
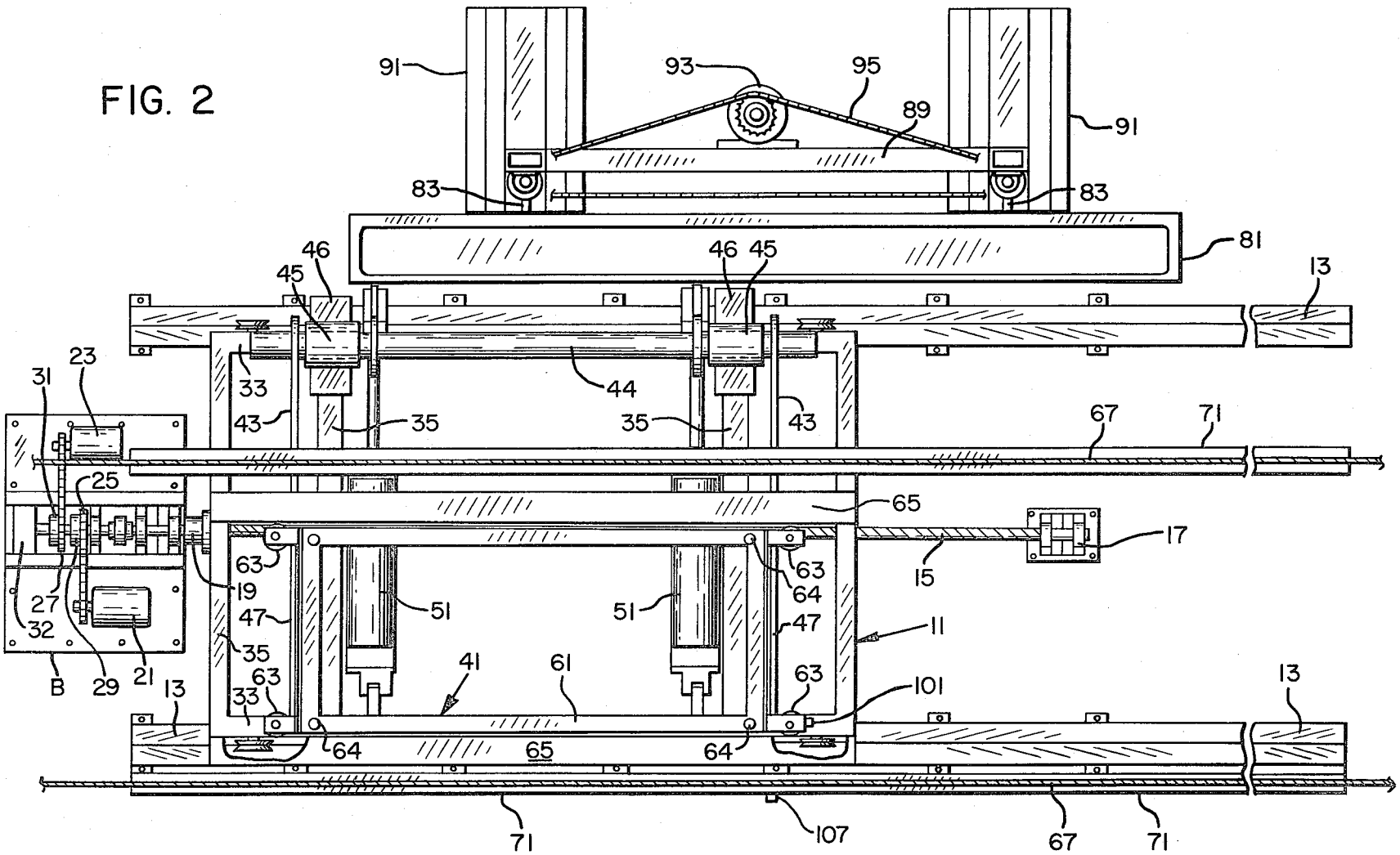
FIG. 2 is a plan view of the dipper, with the posts not being shown to reveal the construction of components of the dipper.

The tilt carrier 41 includes a post carrying rack 61 (FIG. 3) in the form of an open framework which is supported on the tilt carrier by air springs or bags 63. These are stabilized by limited-motion guide devices 64 (FIG. 2). The rack 61 has a pair of parallel laterally spaced magnetic bars 65, whose upper surfaces are disposed at a level beneath that of a pair of conveyor cables 67 (FIG. 3) when the air springs are inactive, but above that of the cables (to pick up posts thereon) when the air springs 63 are actuated. The cables ride on the top surfaces of a pair of longitudinally extending cable support members 71. These members are supported by uprights 73 which are secured at their lower ends to the floor.

Disposed at one side of the shuttle car is a paint tank assembly including a longitudinally extending tank or trough 81. (FIGS. 2 and 3) which has a pair of brackets 83 (FIG.3) equipped with ball nuts 85 for receiving a pair of upright ball screws 87. The screws are journaled at their upper and lower ends in an open framework 89 which has a base portion 91 secured to the floor. A motor 93 (FIG. 2) is mounted on the framework 89 and has a flexible driving connection 95 with the nuts 85 so that when the motor operates in one direction, the tank 81 is elevated, and when operated in the opposite direction, the tank is lowered.

FIGS. 4–7 show the sequence of operations. It is pointed out that the scale of the drawing has been foreshortened for purposes of illustration, but the principle shown in FIGS. 4–7 is valid. The cables 67 are shown as conveying a number of posts P along from left to right. The posts can be considered as constituting a series of batches or groups, four of which are numbered 1, 2, 3 and 4 in FIGS. 4–7. The shuttle car 11 is shown only schematically, as is the post carrier 61 and the elevatable trough or tank 81.

In FIG. 4 it is assumed that the shuttle car and rack underlie post group 3, having just returned from right to left after depositing post group 2. First, the air springs 63 are activated to lift off the post group 3, whereupon the magnetic bars 65 are activated to releasably hold such posts onto the rack 61. The shuttle car is now driven to the left by motor 21, sheave 25, and clutch 29. The cylinders 51 are almost immediately contracted to swing the tilt carrier and its rack 61 from their horizontal positions to the broken line vertical position of FIG. 3, this being timed such that tank 81, in the process of being elevated by motor 93, rises beyond the lower ends of the posts as the parts are shown in FIG. 3 (and FIG. 5), to immerse or dip the lower end portions of the traveling posts in a paint bath contained within the tank. The tank is long enough to allow dipping of the traveling posts without physical interference between the tank and posts.

The immersion is brief and the tank immediately descends and the shuttle car continues moving to the right with the posts vertical to allow them to drip, for a desired period of time normally considerably in excess of the actual time of immersion. Then, shortly before the shuttle car reaches its right hand extreme position, the cylinders 51 are extended to swing carrier 41 and its rack downwardly to a horizontal position just above its final rest position. The carrier 41 now tracks the preceding group of posts, group 2, until a limit switch 101 (FIG. 2) on the tilt carrier 41 engages the nearest post of such group. When this occurs, brake 32 is actuated to stop the car and the magnet bars and air springs are inactivated to deposit post group 3 onto the cables 67 in proper spaced relation to group 2 so as to avoid a break in the continuity of the spacing of the posts being transported by the cables.

It is apparent from the above description that motor 21 drives the shuttle car from left to right at a rate exceeding that of the cables 67, to enable post group 3 to catch up with and track post group 2, and then to be deposited as recited above.

At start up in the morning, or in case the preceding post are inadvertently disarranged, the shuttle car will engage a limit switch 103 located on one of the tracks 13 (FIG. 1) to actuate brake 32, stop the car, and cause deposit of the transported group of posts onto the cables.

While post group 3 has been dipped and moved to the right, the posts remaining on the cables at the left hand side of the machine have been advancing as shown in FIGS. 5 and 6. After depositing post group 3 on cables 67, the shuttle car is rapidly driven in the reverse direction by motor 23, sheave 27 and clutch 31, until the car engages a limit switch 105 (FIG. 1) on one of the tracks 13 to actuate brake 32 to stop the travel of the shuttle car in a position to pick up post group 4. The movement effected by motor 23 is even substantially faster than that caused by motor 21, and sufficiently fast that car 11 arrives slightly ahead of time. Shortly thereafter, the leading post of group 4 engages a limit switch 107 (FIG. 2) on one of the cable support members. This initiates a succeeding cycle of operation like that previously described. The cycle of movement effected by motors 21 and 23 is such that the shuttle car can move back and forth picking up, dipping, depositing groups of posts and returning in such a time frame as to maintain the continuity of flow of the posts on cable 67 and without interrupting such flow.

For convenience in illustration, the tilt frame and rack are shown shorter than the shuttle car 11. Preferably they are longer and extend beyond the ends of the car.

A circuit diagram showing an arrangement for obtaining the above desired sequence of operation is unnecessary, because once the components are set forth and located and the sequences recited, such circuitry is well within the skill of those skilled in the art. Such a circuit is deemed incorporated herein by reference.

While we have shown and described a preferred embodiment of our invention, it will be apparent to those skilled in the art that changes and modifications may be made without departing from our invention in its broader aspects. We therefore intend the appended claims to cover all such changes and modifications as fall within the true spirit and scope of the invention.

What is claimed is:

1. In a machine for dipping fence posts without interrupting the continuous flow of such posts along a predetermined path in a predetermined direction, said machine comprising traveling means interposed in a gap in said flow of posts, said traveling means having means for picking up a group of posts in horizontal positions, elevating such posts to a vertical dipping position, dipping said posts and then returning them back to horizontal, and depositing them in said flow path, power means for driving said traveling means in said predetermined direction at a faster rate of speed than that of said rate of flow to advance said group beyond the positions they would occupy if left in said flow, said power means causing the traveling means to return in the opposite direction for picking up a second group of posts to be dipped, said power means operating at a speed such that the time for completion of a cycle of its travel is not greater than the time necessary for a group of posts in said flow path to move from one space into the next adjacent space.

2. A machine for dipping fence posts as described in claim 1, having a dip tank located in the elevation zone of such posts, and means for elevating said tank to effect dipping of the elevated posts, said power means causing movement of said traveling means while the posts are being dipped, said traveling means maintaining said posts vertical for a predetermined period of time after leaving said tank.

3. In a machine for dipping fence posts as described in claim 1, wherein said traveling means is operable to track the preceding group of posts after the first mentioned group is returned to the horizontal, said traveling means includes switch means for engaging the trailing post of such preceding group to effect depositing the first mentioned group.

4. In a machine for dipping fence posts as described in claim 1, including switch means for stopping said traveling means at the end of its return movement, and other switch means engageable by the next group of posts to be picked up for initiating a cycle of movement of said traveling means.

5. In a machine for dipping fence posts as described in claim 1, wherein said traveling means is operable to track the preceding group of posts after the first mentioned group is returned to the horizontal, said traveling means includes switch means for engaging the trailing post of such preceding group to effect depositing the first mentioned group, switch means for stopping said traveling means at the end of its return movement, and other switch means engageable by the next group of posts to be picked up for initiating a cycle of movement of said traveling means.

6. In a machine for dipping fence posts as described in claim 1, wherein said traveling means includes a shuttle car, a tilt device on said car for picking up posts, said tilt device including a post rack and lift means for lifting said rack, and magnetic means on said rack for magnetically clamping said posts against movement relative to said rack.

7. In combination: a pair of parallel cables for carrying a series of posts along horizontally in a predetermined direction, traveling means for picking up the first group of posts, elevating such posts to a vertical dipping position, and dipping said posts and returning them to the horizontal and depositing them on the cables in advance of the positions they would occupy if not removed from said cables to provide a gap in said series, and means for causing said traveling means to return to pick up a subsequent post group and elevate such posts and return them to the horizontal and deposit them on said cables next to the first group to commence establishing a second series of posts.

8. A machine as described in claim 7, and having a dip tank located in the elevation zone of such posts, and means for elevating said tank to effect dipping of the elevated posts said power means causing movement of said traveling means while the posts are being dipped, said traveling means maintaining said posts vertical for a predetermined period of time after leaving said tank.

9. A machine as described in claim 7, wherein said traveling means being operable to track the first group of posts after the subsequent group is returned to the horizontal, said traveling means including switch means for engaging the trailing post of such first group to effect depositing the subsequent group, switch means for stopping said traveling means at the end of its return movement, and other switch means engageable by the next group of posts to be picked up for initiating a cycle of movement of said traveling means.

10. The method of dipping fence posts without interrupting the continuous flow of such posts along a predetermined, horizontal path in a predetermined direction, comprising:

removing the leading group of posts from said horizontal path, elevating said leading group to a vertical position, dipping said posts, advancing said posts in said predetermined direction at a faster rate of speed than the continuous flow rate returning said group of posts into said horizontal flow path in spaced relation forwardly of the trailing posts to provide a gap in such flow path, returning to a successive group of posts and then removing the same from such path, dipping the same, and advancing the same at said faster rate and then returning the same into said flow path in adjacent relation to the first mentioned group.

11. In a fence post dipping machine, a conveyor comprising a pair of endless cables having parallel horizontal upper reaches, adapted to carry a series of fence posts along in regularly spaced relation crosswise on said cables, means for driving said cables to cause the upper reaches to travel past a pick up station and then past a downstream located deposit station, fence post pick up means including a shuttle car mounted for movement back and forth parallel to said cables, means on said car projectable upwardly between said cables to pick up a group of fence posts therefrom at said pick up station and move said group to vertical dipping positions while traveling parallel to said cables, horizontally stationary dip tank means disposed to receive at least portions of said fence post group and having a length sufficient to permit travel of such group while it is being dipped, said fence post pick up means subsequently returning said group horizontally to said cables at said deposit station, and power means for driving said shuttle from said pick up station to said deposit station and back to said pick up station in the time it takes the next subsequent group of fence posts to arrive at said pick up station.

* * * * *